US005094095A

United States Patent [19]

Barrois et al.

[11] Patent Number: 5,094,095

[45] Date of Patent: Mar. 10, 1992

[54] PRINTING PLATE BENDING APPARATUS

[75] Inventors: Claus D. Barrois, Marktheidenfeld; Philipp A. Dieterich, Randersacker; Anna B. Ziegler, Ochsenfurt, all of Fed. Rep. of Germany

[73] Assignee: Koenig & Bauer Aktiengesellschaft, Wurzburg, Fed. Rep. of Germany

[21] Appl. No.: 614,268

[22] Filed: Nov. 16, 1990

[30] Foreign Application Priority Data

Nov. 20, 1989 [DE] Fed. Rep. of Germany ..... 3938477

[51] Int. Cl.[5] ..... B21D 5/04

[52] U.S. Cl. ..... 72/320; 72/323; 72/305

[58] Field of Search ..... 72/319–323, 72/305, 312–315, 293

[56] References Cited

U.S. PATENT DOCUMENTS

| | | | |
|---|---|---|---|
| Re. 319,938 | 7/1985 | Klukow | 72/319 |
| 1,710,985 | 4/1929 | Jacobsen | 72/323 |
| 2,190,423 | 2/1940 | Henricson . | |
| 2,234,170 | 3/1941 | Hack | 72/305 |
| 2,932,336 | 4/1960 | Winters | 72/305 |
| 3,677,057 | 7/1972 | MacKenzie | 72/305 |
| 4,092,840 | 6/1978 | Eckold | 72/321 |
| 4,598,568 | 7/1986 | Stadler | 72/320 |

FOREIGN PATENT DOCUMENTS 2013364 7/1971 Fed. Rep. of Germany .

*Primary Examiner*—Daniel C. Crane
*Attorney, Agent, or Firm*—Jones, Tullar & Cooper

[57] ABSTRACT

A printing plate end bending apparatus utilizes a machine table having a printing plate abutment surface together with plate leading and trailing end support saddles which each also have plate end abutment surfaces. Each plate end saddle is provided with pivotable side plates that carry plate end hold-down members and bending beams.

7 Claims, 4 Drawing Sheets

PRINTING PLATE BENDING APPARATUS

FIELD OF THE INVENTION

The present invention is directed generally to a printing plate bending apparatus. More particularly, the present invention is directed to an apparatus for bending the ends of a printing plate. Most specifically, the present invention is directed to a printing plate bending apparatus in which the printing plate can be moved into and out of the apparatus without moving the plate bending bars. The printing plate bending apparatus utilizes a printing plate supporting table which has a generally concave abutment surface. The ends of this abutment surface define plate end support saddles. Each plate end support saddle has a plate end bending beam which is carried by a movable support frame that is movable into and out of a plate end bending position. This allows the printing plate ends to be provided with a required bend in an expeditious manner.

DESCRIPTION OF THE PRIOR ART

Printing plates often have a metal base which is bent at its ends to effect attachment of the printing plate to the peripheral surface of the plate cylinder. Various types of printing plate end clamping assemblies are known in the prior art and are usable to secure the ends of the printing plate to the plate cylinder. As is generally known, many of these printing plate clamping or securing means require that the ends of the plate cylinder be provided with a bend which will be secured in the plate end clamping apparatus of the plate cylinder.

It is imperative that the ends of the plate cylinder be provided with an accurate and uniform bend so that the plate will be properly secured on the plate cylinder. Since plate registry and alignment are often dependent on the proper securement of the end of the plate in the plate end receiving grooves in the plate cylinder, it is clear why the ends of the printing plate must be bent or formed accurately.

A bending device which is usable to bend the ends of a plate cylinder is set forth in German published unexamined patent application No. 2013364. This apparatus uses a bending bar and a bending roller which cooperates with the bending bar to effect the bending of each end of the printing plate. The bending bars are pivotable about an axis so that the printing plate, whose ends have been bent by using the printing plate end bending device, can be removed from the apparatus. However, this movement of the bending bars out of the way can lead to the front and back bending bars moving out of parallelism. This loss of parallel alignment of the front and back bending bars may result in the ends of the plate cylinder having bends which are not aligned with each other. This will clearly make it difficult to properly mount and align the printing plate on the plate cylinder.

It will thus be seen that there is a need for a printing plate bending apparatus which will overcome the limitations of the available prior art devices. The printing plate bending apparatus in accordance with the present invention provides such a device and is a substantial improvement over the prior art devices.

SUMMARY OF THE INVENTION

It is an object of the present invention to provide a printing plate bending apparatus..

Another object of the present invention is to provide a printing plate end bending apparatus.

A further object of the present invention is to provide a printing plate end bending apparatus in which the printing plate can be removed from the plate bending apparatus without moving the bending bars.

Yet another object of the present invention is to provide a printing plate end bending apparatus having a generally concave printing plate abutment surface.

Still a further object of the present invention is to provide a printing plate end bending apparatus having spaced printing plate end supporting saddles.

Even yet another object of the present invention is to provide a printing plate end bending apparatus having plate end bending beams and bars.

As will be discussed in detail in the description of the preferred embodiment which is set forth subsequently, the printing plate bending apparatus in accordance with the present invention utilizes a generally concave abutment surface, which is provided with vacuum ports, to support the printing plate. The ends of the plate are supported by somewhat convex abutment surfaces of plate end saddles. Each plate end saddle carries pivotally supported side plates which in turn carry plate end bending beams that are usable to bend the ends of the printing plate. The bending beams are supported by bending beam frames which are, in turn, carried by the pivotable side plates. In this way the bending beams can be moved into and out of their plate end bending positions by movement of the pivotable side frames. This keeps the bending beams properly aligned while still allowing the ends of the printing plate to be placed in and removed from the printing plate bending apparatus.

10 The printing plate end bending apparatus of the present invention provides a device for bending a printing plate in which it is possible to move the printing plate without any problems and to take it out of the bending device without moving the bending bars. It is a particular advantage of the present invention that I5 the tolerance errors in parallelism, which are apt to appear between the printing plate back and front edges and which, in the prior art devices, have been caused by the use of movable bending bars, are avoided in the present device.

Another advantage of the printing plate end bending apparatus of the present invention is that the printing plates can be bent by more than 90° at both ends. This allows these printing plates to be used in printing machines with very narrow cylinder grooves of, for example, 5 mm. Security printing machines often have such narrow cylinder grooves and extremely small clamping travels.

The plate end bending apparatus of the present invention also at least partially pre-forms the printing plate in th clamping areas. The abutment surfaces of the plate end support saddles are somewhat convex. This preforms the ends of the printing plate itself adjacent the clamping ends so that the plate is somewhat pre-shaped to fit on the peripheral surface of the plate cylinder. The printing plate end bending device can also be adjusted to accommodate different format lengths.

It will be seen that the printing plate end bending assembly of the present invention provides a device which will accurately and effectively bend the ends of printing plates. As such, the device is a significant advance in the art.

BRIEF DESCRIPTION OF THE DRAWINGS

While the novel features of the printing plate bending apparatus in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

Figure 1:
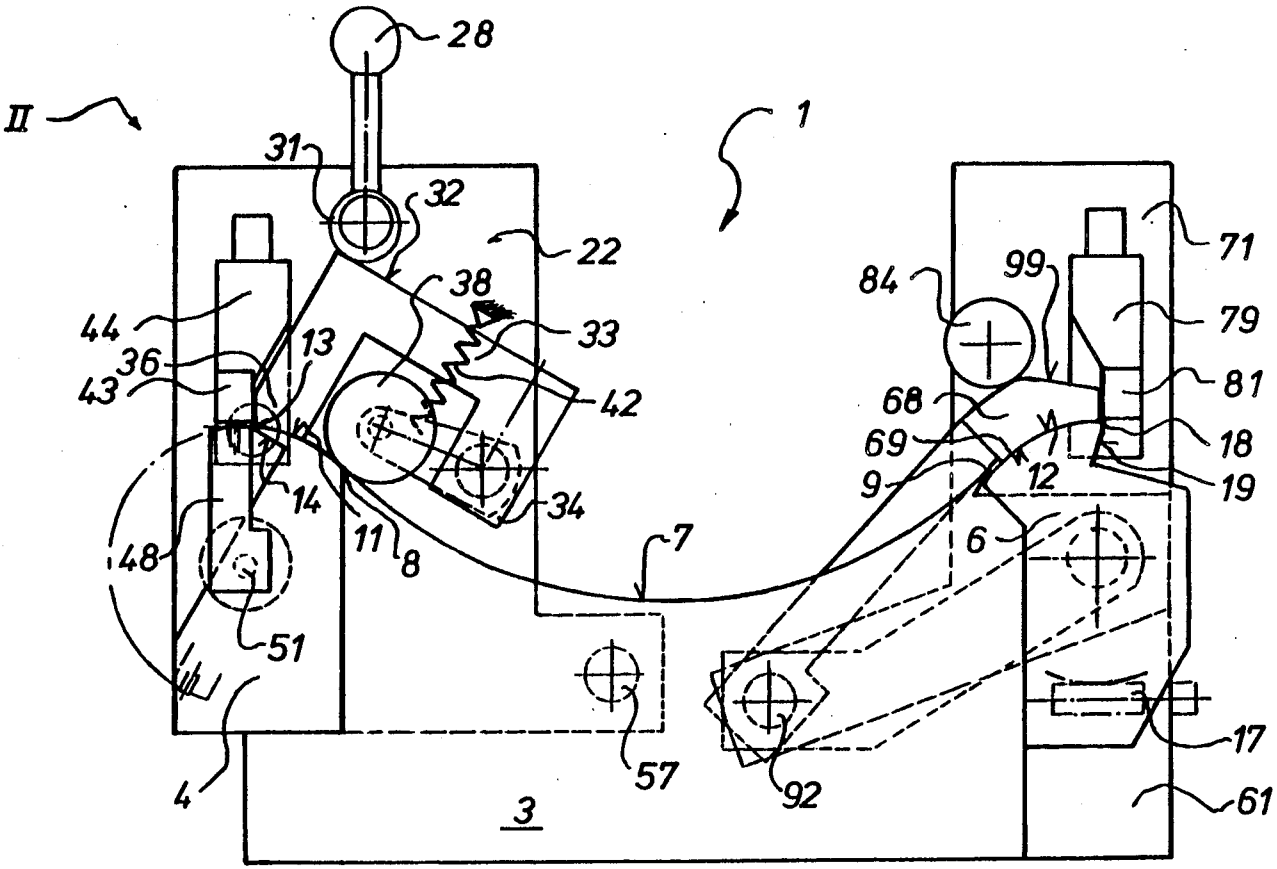
FIG. 1 is a schematic side elevation view of the printing plate bending apparatus of the present invention and showing the apparatus in an operating position.

Turning initially to FIG. 1, there may be seen, generally at a printing plate bending apparatus in accordance with the present invention. This printing plate bending apparatus 1 is intended for use in bending flexible printing plates 2 which are usable with generally well-known rotary printing machines. The printing plate bending apparatus 1 has a machine table 3 which is 10 provided with a printing plate abutment surface 7, and with two printing plate end support saddles 4 and 6. This printing plate abutment surface 7 is generally in the shape of a concave dome which extends from a left end 8 adjacent the first saddle 4 to a right end 9 adjacent the second saddle 6. Each of the end saddles 4 and 6 has a printing plate end abutment surface and 12 respectively. These end abutment surfaces 11 and 12 are each generally convex and each has a generally cylindrical shape.

The saddle 4, which will receive the front or leading surface of a printing plate whose ends are to be bent, is firmly connected to the machine table 3 and is provided with an unmovable bending bar 13. An angle e is formed by the abutment surface 11 of the front saddle 4 and a bottom surface 14 of the bending bar 13. This angle $\alpha$ is, in the depicted preferred embodiment, generally about 30°. This means that the front edge of the printing plate will be bent by about 150° in the depicted preferred embodiment. It will be understood that other angles $\alpha$ are also within the scope of the invention.

The saddle 6 which carries the abutment surface 12 for the rear or trailing portion of the printing plate is adjustably supported by the machine base 3. This provides the possibility of a formal adjustment which may be accomplished by an adjusting means generally at 17. This adjusting means may be a worm drive assembly or the like. The worm drive 17 can be firmly fixed in a desired position with great accuracy and without clearance.

A bending bar 18 is provided on the rear saddle 16 and this bengin bar has an angle $\beta$ between the abutment surface 12 and a bottom or rear side 19 of the bending bar 18 of generally about 80°. This means that the trailing edge of the printing plate will be bent at an angle of generally about 100° in the depicted embodiment of the invention. It will be understood that other angles $\beta$ are also possible.

Figure 2:
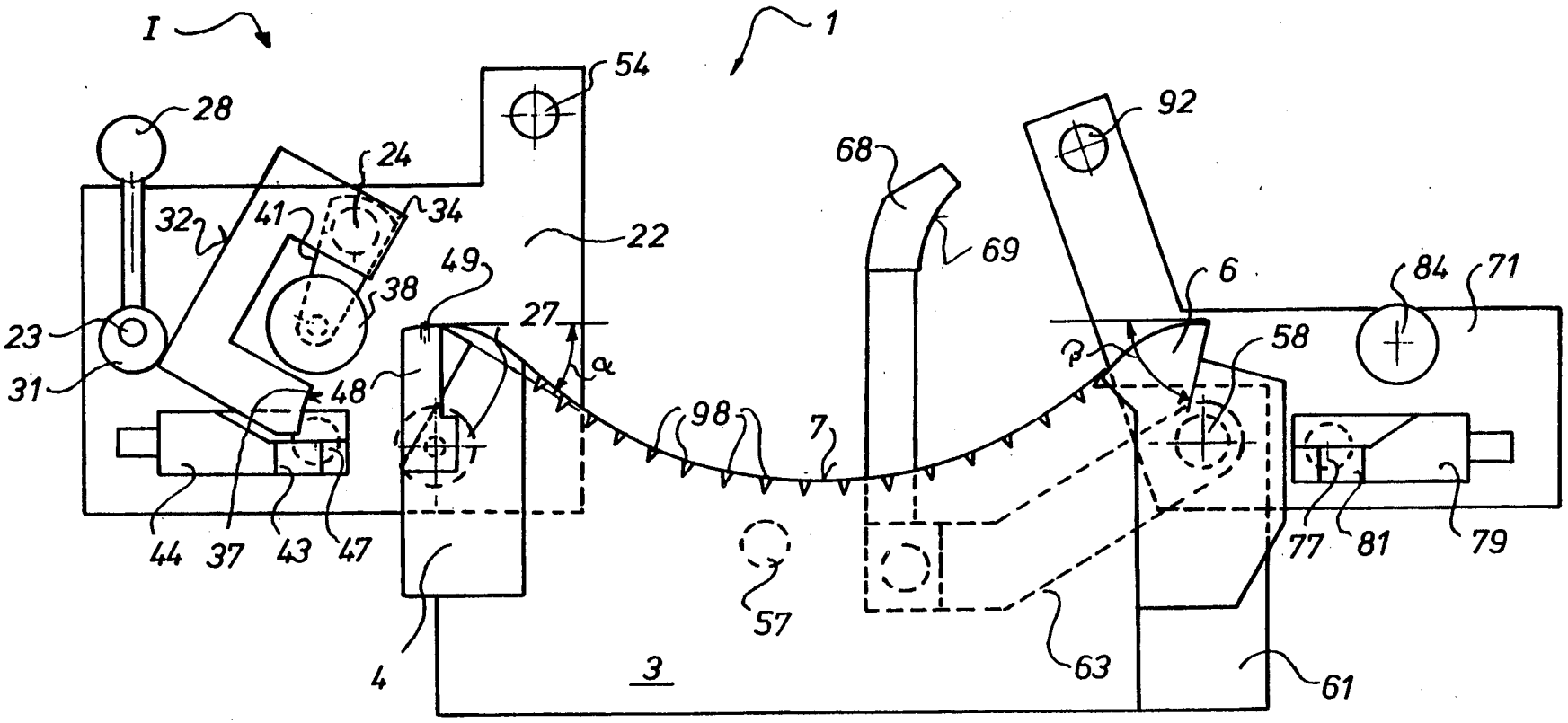
FIG. 2 is a schematic side elevation view generally similar to FIG. 1 and showing the apparatus in a loading or unloading position.
Figure 3:
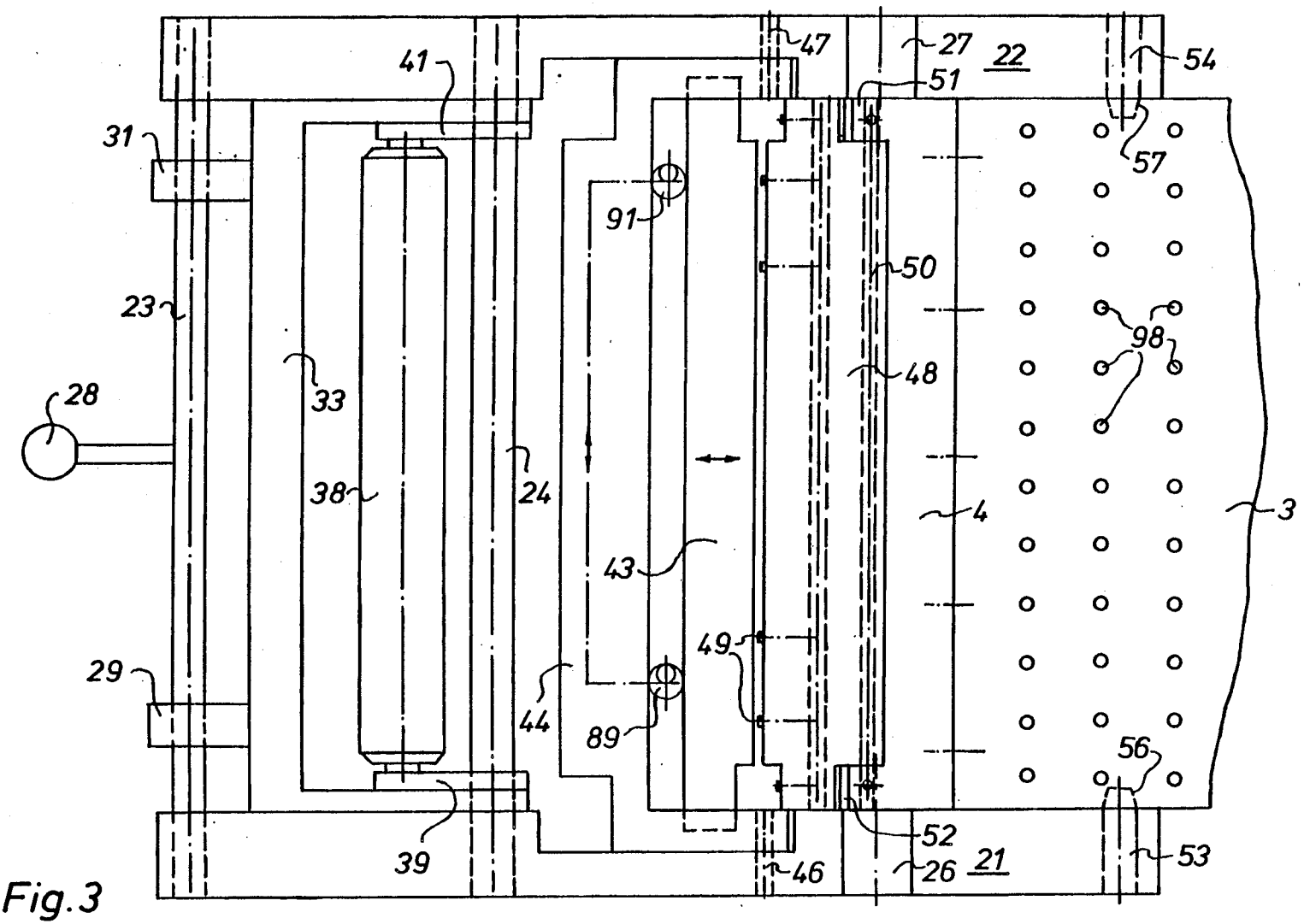
FIG. 3 is a top plan view of the printing plate leading edge bending portion of the present apparatus.

Referring now more particularly to FIGS. 2 and 3, a pair of side plates 21 and 22 are movably supported on either side of the machine table 3 and generally adjacent the printing plate front end saddle 4. These two side plates 21 and 22 are connected to each other by a shaft 23 and an axle 24, as seen more clearly in FIG. 3. Each side plate 2I and 22 is swingable about a ]ournal 26 or 27, respectively, which journals 26 and 27 are carried by the machine table 3 in the area of front saddle 4.

Shaft 23 is rotatably supported in, and extends between the spaced side plates 21 and 22. As seen in FIGS. 2 and 3, shaft 23 carries a centrally located handle 28 and a plurality of spaced clamping disks 29 and 31. These disks 29 and 3I are fixed to shaft 23 for rotation with it, and as may be seen most clearly in FIG. 2, are eccentrically located on shaft 23. Each clamping disk 29 and 31 bears against an upper surface 32 of a generally U-shaped bracket generally at 33. Bracket 33 is movably supportive on the axle 24 at a first end 34 of bracket 33. A second end 36 of the U-shaped bracket 33 extends across the saddle 4 and has a lower surface 37 which is curved correspondingly to the shape of the abutment surface 11 of the saddle 4.

The generally U-shaped bracket 33 forms the frame and support for a spring biased press-on roller 38. This roller 38 is rotatably supported by lever arms 39 and 41 that are rotatably supported on the axle 24 interiorly of the ends 34 of the U-shaped bracket 33. Compression springs 42 are attached to the lever arms 39 and 41 at first ends, and to the side plates 21 and 22 at second ends. These compression springs 42 apply an impression force to the press-on roller 38 so that this roller 38 will press against the abutment surface 7 or 11 of the machine table 3 or the plate leading end saddle 4, as may be seen in FIG. 1.

A bending beam 43 is supportive for vertical movement in a frame 44. This frame 44 is, in turn, carried by the side plates 21 and 22, all as may be seen in FIGS. 1-3. A pair of bolts 46 and 47 are used to attach the bending beam frame 44 to the side plates 21 and 22. This bending beam 43 will be positioned in contact with the fixed bending bar 13 on the saddle 4 when the side plates 21 and 22 are oriented as depicted in FIG. 1. This bending beam 43 also contacts and cooperates with a register bar 48. Register bar 48 has a plurality of spring biased register pins 49 which function in a manner to be discussed subsequently. Register bar 48 is pivotably supportive for rotation about a fixed axis 50. This pivotal movement of register bar 48 is accomplished about two spaced side supports 51 and 52 which are attached to plate leading edge saddle 4. These supports 51 and 52 may be seen most clearly in FIG. 3.

The two side plates 21 and 22 are movable between a loading/unloading position I, depicted in FIG. 2; and an operating position II which is depicted in FIG. 1. A stopping device is provided to lock the side plates 21 and 22 in their operating position II with respect to the machine table 3. This stopping or locking means may take the form of spring biased bolts 53 and 54 which are carried by the side plates 21 and 22, respectively, and which are receivable in cooperatively placed countersunk bore holes 56 and 57 in the machine table 3.

Figure 4:
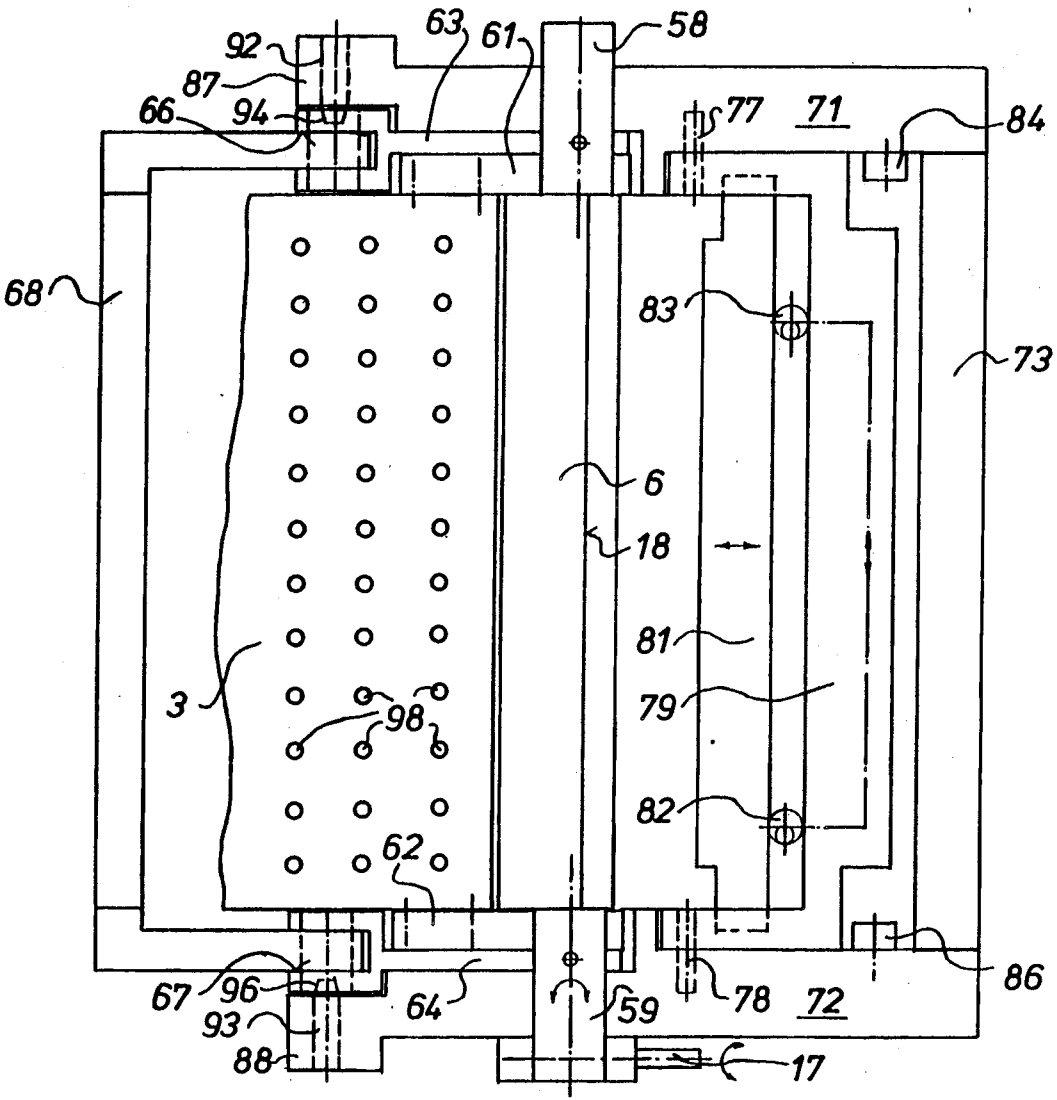
FIG. 4 is a top plan view of the printing plate trailing edge bending portion of the present apparatus.

Referring now to FIGS. 1, 2, and 4, the saddle 6 for the rear or trailing portion of the printing plate whose edges are to be bent, is provided with two spaced, outwardly extending journals 58 and 59. These ]ournals 58 and 59 are received in spaced bearing brackets 61 and 62, respectively, which are, in turn, securely attached to machine table 3. Each of these journals 58 and 59 carries a first end of a fixed lever arm 63 or 64. Each of these lever arms 63 or 64 terminates at a second end in a split or fork-shaped bearing position 66 or 67 which provides an attachment point for a transverse hold-down member 68, as seen most clearly in FIG. 4. This hold-down member 68 has a lower surface 69 which is curved to cooperate with the curved upper surface of the abutment surface 12 of the plate trailing end support saddle 6.

A pair of spaced side plates 71 and 72 are also rotatably or pivotably supported by the journals 58 and 59 and these side plates are located outside of the lever arms 63 and 64 which are themselves locked in place on the journals 58 and 59. The two side plates 71 and 72 are connected to each other by a crossbar 73, as may best be seen in FIG. 4. As may also be seen in FIG. 4, a gear or gear segment, such as a worm wheel 74, may be secured to journal 59. This worm wheel 74 may be in meshing engagement with a drive, such as a spindle 76 to form the worm drive, generally at 17, which will allow the saddle 6 to be positionally adjusted with respect to machine table 3. As may be seen in FIG. 1, the spindle 76 may be carried by the bearing bracket 62.

A frame 79 is pivotably supported within the side plates 71 and 72 by means of two spaced support bolts 77 and 78, as seen in FIGS. 1, 2, and 4. A second bending beam 81, which will bend the trailing edge of the printing plate, is supported in frame 79 for vertical movement. This bending beam 81 is schematically depicted as being lowerable with respect to second bending bar 18 by eccentrically supported adjusting arms 82 and 83. The first bending beam 43 is similarly lowerable with respect to its bending bar 13 by similar eccentrically supported adjusting arms 89 and 91, as are schematically shown in FIG. 3. Press-on rollers 84 and 86 are also carried by the spaced side frames 71 and 72 and these bear against upper surfaces of the down holder 68, as seen in FIG. 1 when the side plates 71 and 72 are in their operating position.

The operating position of the side plates 71 and 72 is maintained in the operating position II shown in FIG. 1 by stopping devices situated at the lower ends 87 and 88 of the side plates 71 and 72. As seen in FIG. 4, these stopping devices include spring loaded bolts 92 and 93 which are receivable in countersunk bores 94 and 96 formed in the lever arms 63 and 64.

In use of the printing plate bending apparatus of the present invention, the side plates 21 and 22 of the front plate saddle 4 and the side plates 71 and 72 of the rear plate saddle 6 are moved into the loading or application position I, as depicted in FIG. 2. This allows the printing plate to be placed on the machine table abutment surface 7 and the saddle abutment surfaces 11 and 12. At this point, the plate is merely laid in place. A plurality of preformed holes on the leading end of the printing plates are aligned with the pins 49 on the register bar. The side plates 21 and 22 are then moved down into the operating position II shown in FIG. 1 at which time the spring loaded bolts 53 and 54 are received in their respective countersunk bores 56 and 57. As the side plates 21 and 22 are moved into position, the press-on roller 38 will roll over the register pins 49 and may depress them momentarily. Press-on roller 38 may be provided with a resilient rubber covering into which the register pins 49 may press. It is also possible to provide press-on roller 38 with slots that are aligned with the register pins 49. These slots will have no adverse effect on the operation of the press-on roller 38.

As the side plates 21 and 22 are lowered into their operating position II, the press-on roller 38 will, as discussed above, roll over the beginning of the printing plate until it reaches a transition line, generally at 8, between abutment surface 11 and abutment surface 7. This rolling travel of press-on roller 38 will pull the printing plate firmly toward the register pins 49 and will pre-form the plate to the curvature of the abutment surface 11 of the saddle 4. The curvature radii of the saddles 4 and 6 are sized to be generally about 10% smaller than the actual radius of the plate cylinder to which the printing plate will be applied. This will apply a residual distortion or deformation to the printing plate which will almost exactly correspond to the curvature of the plate cylinder once the printing plate is removed from the bending machine 1.

The generally U-shaped bracket generally at 33, which carries the press-on roller 38 as well as the primary surface 37 will be pressed against the leading portion of the printing plate. This is accomplished by the exertion of a force on the handle 28 which will rotate the eccentric clamping disks 31. The press-on surface 37 will contact the printing plate on the saddle 4 just after the register bar 48.

As may be seen in FIGS. 2, 3, and 4, the abutment surface 7 of the machine table 3 is provided with a plurality of rows, such as 12 rolls, with each of these rolls having 16 boreholes 98 to provide a total of 192 suction boreholes 98 on abutment surface 7. These suction boreholes 98 can progressively, for example in a left to right manner, be provided with a reduced pressure. This will secure the printing plate to the abutment surface 7 up to the transition line 9 between machine table abutment surface 7 and second saddle abutment surface 12. Once this has been done, the hold-down member 68 will be rotated down in a clockwise direction onto the trailing edge of the plate. Now that the hold-down member 68 is in place with its curved bottom surface 69 in contact with the plate, the second set of side plates 71 and 72 may be rotated into their operating position II, as depicted in FIG. 1. This will bring the press-on rollers 84 and 86 into contact with an upper surface 94 of the down holder 68 and will firmly press it onto the trailing end of the printing plate. This brings the printing plate firmly into position on the bending machine 1.

With the printing plate securely positioned on the bending machine 1, the bending beams 43 and 81 are vertically lowered until they fit firmly on the printing plate ends. The register pins 49 can now be lowered into the register bar 48 and the register bar will, in turn, be rotated in a counterclockwise direction as depicted in the dot-dash lines in FIG. 1. The bending beam 43 together with its support frame 44 may now also be rotated in a counterclockwise direction around the bolts 46 and 47 through the angle $\alpha$ of generally about 150°, as discussed previously. In a similar manner, the bending beam 81 is rotated, with its frame 79, in a clockwise manner through an angle $\beta$ of generally about 100°. These rotations of the bending beams 43 and 81 will bend the plate ends about the corresponding bending bars 13 and 18, respectively.

The hold-down members 33 and 68 may now be moved off the printing plate so that the plate can be removed from the table 3. This removal may be made easier by the application of high pressure air to the boreholes 98. Because of the elastic internal tension of the printing plate, it will tend to spring back into its stretched state in the area of the machine table 3. This will have the effect of essentially horizontally unhinging the plate ends out of the bending bars 13 and 18. Now the printing plate can easily be taken off the machine table 3 of the printing plate bending apparatus 1.

While a preferred embodiment of a printing plate bending apparatus in accordance with the present invention has been set forth fully and completely hereinabove, it will be apparent to one of skill in the art that a number of changes in, for example, the overall size of the table, the number of vacuum boreholes, the type of journals used, and the like, may be made without departing from the true spirit and scope of the invention, which is accordingly to be limited only by the following claims.

What is claimed is:

1. A printing plate bending apparatus which is usable to bend leading and trailing end portions of a printing plate, said printing plate bending apparatus comprising:

a machine table having a concave printing plate abutment surface, said concave printing plate abutment surface having a uniform, first direction of curvature;

a printing plate leading end supporting saddle formed at a first end of said machine table, said printing plate leading end supporting saddle having a first, convex printing plate leading end abutment surface which has a second direction of curvature;

a printing plate trailing end supporting saddle formed at a second end of said machine table, said printing plate trailing end support saddle having a second, convex printing plate trailing end abutment surface which has said second direction of curvature;

a printing plate leading end bending bar fixed to said printing plate leading end supporting saddle;

a printign plate trailing end bending bar fixed to said printing plate trailing end supporting saddle;

a printing plate leading end bending beam frame pivotably secured to said printing plate leading end supporting saddle;

a printing plate leading end bending beam carried by said printign plate leading end bending beam frame and movable with respect thereto, said printing plate leading end bending beam cooperating with said printing plate leading end bending bar to bend a leading end of a printign plate positioned on said printing plate bending apparatus;

a printing plate trailing end bending beam frame pivotably secured to said printing plate trailing end supporting saddle; and a printing plate trailing end bending beam carried by said printing plate trailing end bending beam frame and movable with respect thereto, said printing plate trailing end bending beam cooperating with said printign plate trailing end bending bar to bend a trailing end of a printign plate positioned on said printing plate bending apparatus.

2. The printing plate bending apparatus of claim 1 wherein a curvature radius of each of said convex plate end abutment surfaces is less than a curvature radius of a plate cylinder on which said printing plate is to be fixed.

3. The printing plate bending apparatus of claim 1 wherein at least one of said first and second printing plate end supporting saddles is pivotably secured to said machine table.

4. The printing plate bending apparatus of claim 1 further including means to hold ends of a printing plate on said first and second printing plate end supporting saddles.

5. The printing plate bending apparatus of claim 1 further including a printing plate end pressing roller carried by one of said first and second printing plate end supporting saddles.

6. The printing plate bending apparatus of claim 1 wherein said machine table abutment surface is provided with vacuum plate hold-down means.

7. The printing plate bending apparatus of claim 3 further including means to adjustably position said pivotable printing plate end supporting saddle.

* * * * *